US005316186A

United States Patent [19]

Prestele

[11] Patent Number: 5,316,186

[45] Date of Patent: May 31, 1994

[54] FULLY DISCHARGEABLE CARTRIDGE FOR PASTE-LIKE SUBSTANCES

[76] Inventor: Eugen Prestele,
Albert-Greiner-Strasse 73, 8900
Augsburg, Fed. Rep. of Germany

[21] Appl. No.: 935,401

[22] Filed: Aug. 26, 1992

[30] Foreign Application Priority Data

Aug. 26, 1991 [DE] Fed. Rep. of Germany ..... 9110529

[51] Int. Cl.[5] ..... B67D 5/00

[52] U.S. Cl. ..... 222/327; 222/386

[58] Field of Search ..... 222/325, 326, 327, 386, 222/386.5, 387, 389

[56] References Cited

U.S. PATENT DOCUMENTS

| | | | |
|---|---|---|---|
| 2,079,744 | 5/1937 | Maguire | 222/326 |
| 2,458,085 | 1/1949 | Ludwig | 222/386 |
| 2,695,735 | 11/1954 | Van Doornik | 222/386 |
| 2,898,007 | 8/1959 | Gassaway | 222/212 |
| 3,042,268 | 7/1962 | Pyles | 222/327 |
| 3,066,836 | 12/1962 | Trumball | 222/327 |
| 3,184,120 | 5/1965 | Undi | 222/209 |
| 4,030,643 | 6/1977 | Van Manen | 222/386 |
| 4,269,330 | 5/1981 | Johnson | 222/386 |
| 4,355,736 | 10/1982 | Schumacker et al. | 222/80 |
| 4,452,370 | 6/1984 | Langensiepen et al. | 222/386 |
| 4,467,942 | 8/1984 | Oshikubo | 222/327 X |
| 4,505,410 | 3/1985 | Coulter | 222/327 X |
| 4,819,836 | 4/1989 | Meckenstock | 222/386 |
| 4,834,268 | 5/1989 | Keller | 222/327 |
| 4,854,485 | 8/1989 | Collins | 222/386 |
| 4,966,468 | 10/1990 | Bruning | 222/386 X |

FOREIGN PATENT DOCUMENTS

| | | | |
|---|---|---|---|
| 344491 | 12/1989 | European Pat. Off. | 222/386 |
| 514787 | 11/1979 | United Kingdom . | |
| 2026098 | 1/1980 | United Kingdom . | |
| 2049060 | 12/1980 | United Kingdom . | |
| 2208227 | 3/1989 | United Kingdom | 222/327 |
| 2208682 | 4/1989 | United Kingdom | 222/326 |

*Primary Examiner*—Andres Kashnikow
*Assistant Examiner*—Lesley D. Morris
*Attorney, Agent, or Firm*—Parkhurst, Wendel & Rossi

[57] ABSTRACT

The invention relates to a cartridge for paste-like substances, including a tubular cartridge body closed at one end by a front end wall having an outlet nipple defining an outlet opening; a plunger for pressing such a paste-like substance through the outlet opening, the plunger being inserted into the open rear end of the cartridge body, wherein an outer periphery of the plunger is in sealing contact with an inner wall of the cartridge body; a journal protruding from and fixed to the plunger, the journal being adapted to penetrate the outlet opening when the plunger rests against the front end wall, the journal being at least the same length as the outlet opening; and at least one continuous longitudinal axial groove formed in at least one of an outer peripheral surface of the journal and an inner wall of the outlet opening, wherein the plunger is adapted to have its entire front surface contact the front end wall of the cartridge upon forcing the journal through the outlet opening.

18 Claims, 5 Drawing Sheets

FULLY DISCHARGEABLE CARTRIDGE FOR PASTE-LIKE SUBSTANCES

BACKGROUND OF THE INVENTION

1. Field of the Invention

The invention relates to a cartridge for a paste-like substance, comprising a tubular cartridge body closed at its front by an end wall which is provided with an outlet nipple delimiting an outlet opening, and a plunger which is inserted into the open rear end of the cartridge body. The plunger lies sealingly against the inner wall of the cartridge body and, upon displacement towards the front end wall of the cartridge body, presses the substance through the nipple opening.

2. Related Art

Paste-like substances for which such cartridges are used include sealing compounds, such as adhesives or the like, which harden from exposure to air. Expressing of the substances from the cartridges may be effected by mechanical or pneumatic extraction pistols, in which a pressure ram or compressed air presses the plunger forward.

The cartridges are made of rigid plastic materials, usually polyethylene (HDPE). Empty cartridges have a relatively large volume, and are thus bulky to dispose of. Accordingly, it is desirable to avoid this problem by reworking the plastics material, such as by grinding the empty cartridges for subsequent recycling.

Here the problem arises, however, that with known cartridges, even when the substance is fully expressed therefrom, the remains a relatively large residual quantity of the substance in the cartridge, on the order of 10 g. To illustrate the problem, reference is made to FIG. 1 of the drawings, which shows in cross-section the front end of an expressed cartridge. The conventional convex shape of the plunger, because of the radial force component generated during the axial upsetting of the plunger, does admittedly facilitate trouble-free sealing with the cartridge body wall. However, when the plunger is pressed forward as far as it will go, a relatively large residual quantity (illustrated by the dark areas) of the substance is left in the spaces remaining between the cartridge body, front end wall, and the convex front face of the plunger. Moreover, a considerable quantity of the paste-like substance is left in the opening of the outlet nipple.

The residual substance leads to smearing of the mills and to clogging. A further and particularly aggravating factor is that the substance remaining in the spaces, even over an extended period of time, does not harden. That is, air is prevented from entering the cartridge since the plunger seals off the opening of the nipple, resulting in the substance being enclosed in an airtight manner in the spaces, thus remaining in a paste-like, i.e. extremely smeary and sticky, state. Grinding empty cartridges containing such non-hardened residual quantities rapidly renders the mills unserviceable.

SUMMARY OF THE INVENTION

The aim of the invention is to remedy the problem just highlighted. The invention thus provides a cartridge for paste-like substances, comprising:

a tubular cartridge body closed at one end by a front and end wall having an outlet nipple defining an outlet opening;

a plunger for pressing such a paste-like substance through the outlet opening, the plunger being inserted into the open rear end of the cartridge body, wherein an outer periphery of the plunger is in sealing contact with an inner wall of the cartridge body; a journal protruding from and fixed to the plunger, the journal being adapted to penetrate the outlet opening when the plunger rests against the front end wall, the journal being at least the same length as the outlet opening; and at least one continuous axial groove formed in at least one of the peripheral surface of the journal and an inner wall of the outlet opening, whereby the plunger is adapted to have its entire front surface contact the front end wall of the cartridge upon forcing the journal through the outlet opening.

Additional features of the present invention are described in relation to the accompanying drawings.

The present invention permits virtually complete discharging of the cartridge, without leaving any substantial residual quantities behind. The residual quantity remaining is confined to a thin film between the front face of the plunger and the end wall of the cartridge body as well as thin strips in the grooves of the journal disposed on the plunger (or in the outlet bore wall), amounting to approximately 0.8 g, i.e. less than one tenth of the conventional residual quantity. Even when the journal of the plunger has already entered the outlet opening, the grooves allow expressing of the material remaining between the plunger and the end wall of the cartridge body and then form air admission channels, which allow rapid hardening of the inevitable slight film of residual material. When grinding empty cartridges, smearing of the mills no longer occurs and insubstantial, hardened film-like residual quantity does not cause any clogging during grinding.

The fact that the journal length is preferably greater than the length of the outlet opening has the effect that, when the plunger is pressed fully forward, the journal visibly projects above the outlet nipple as an indication that the cartridge is in fact fully discharged and may be ground safely.

The arrangement, in tube-like containers, of a journal on a plunger which enters the nipple opening is already known from U.S. Pat. Nos. 2,898,007 and 3,184,120. U.S. Pat. No. 2,898,007 describes such a plunger in a flexible container for more or less viscous products, the container also being closed at the rear. U.S. Pat. No. 3,184,120 describes a tube for similar liquid products containing a sliding plunger, wherein the journal disposed on the plunger is slightly longer than the outlet opening of the tube and visibly projects above the opening when the plunger is in its foremost position to indicate that the tube is empty. The arrangements known in connection with liquid products from these two U.S. Patents are however impossible to use in cartridges of the type presently in question owing to the very high viscosity of the paste-like substances. That is, as the journal enters the outlet opening, further expression of material would be blocked and, if material became trapped, the above-described problems of the material not hardening over a long period and of smearing and clogging of the grinding tools would occur.

A further development of the cartridge according to the invention with an air escape valve (discussed in detail later) between the plunger and its journal offers the advantage of allowing the air to escape which is trapped between the paste-like substance and the plunger when the plunger is inserted into the filled cartridge. Otherwise, trapped air may escape violently out of the nipple or a spout installed as a nozzle at the end of processing of the cartridge, causing splashes and impurities at the processing site as a result of entrained paste-like substance.

BRIEF DESCRIPTION OF THE DRAWINGS

Several embodiments of the invention are described in greater detail hereinafter with reference to the accompanying drawings, which show.

DETAILED DESCRIPTION OF THE PREFERRED EMBODIMENTS

Figure 1:
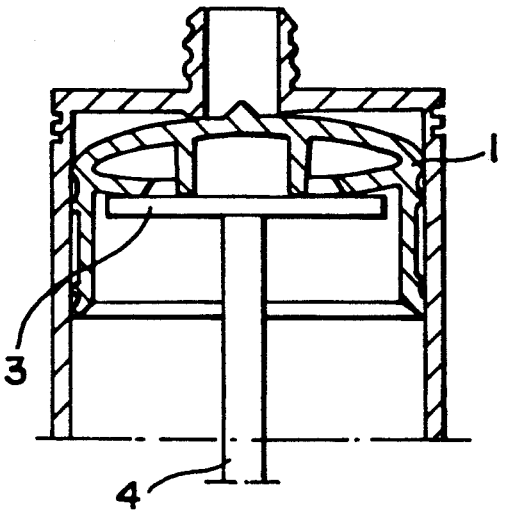
Fig - 1 PRIOR ART
FIG. 1 is an axial cross-section, the front end region of a conventionally expressed cartridge.

FIG. 1, which was already referred to in the introduction, shows in axial section the front end portion of an expressed cartridge, in which the plunger has been pressed into its foremost position. At the periphery, the plunger lies with its doctor lip 1 against the inner wall of the cartridge body; its front face lies against the inner peripheral edge of the outlet opening. Also shown in FIG. are the pressure plate 3 lying against the rear side of the plunger and, connected to pressure plate 3, the pressure ram 4 of an extraction pistol.

Figure 2:
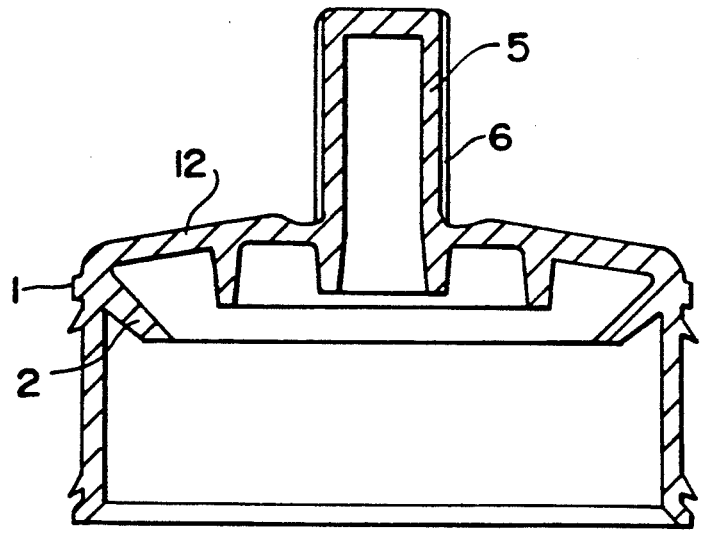
FIG. 2 is an axial cross-section, the plunger of a cartridge according to the invention.

FIG. 2 shows an embodiment of the plunger of a cartridge according to the invention. The plunger is provided with a projecting journal 5, which is longer than the outlet opening delimited by the outlet nipple of the end wall of the cartridge body and which is provided in its peripheral area with a number (e.g. four) of flat grooves 6. The end wall 12 of the plunger is, as illustrated, slightly vaulted so that, when axal pressure is applied, it tries to flatten and so the doctor lip 1 is pressed sealingly into contact with the inner wall surface of the cartridge body. The plunger is however inherently so resilient that the plunger end wall 12, upon striking the end wall of the cartridge body, under the pressure of the pressure plate 3 of the extraction pistol acting on the inner rib 2, contacts the cartridge body along it entire surface.

Figure 3A:
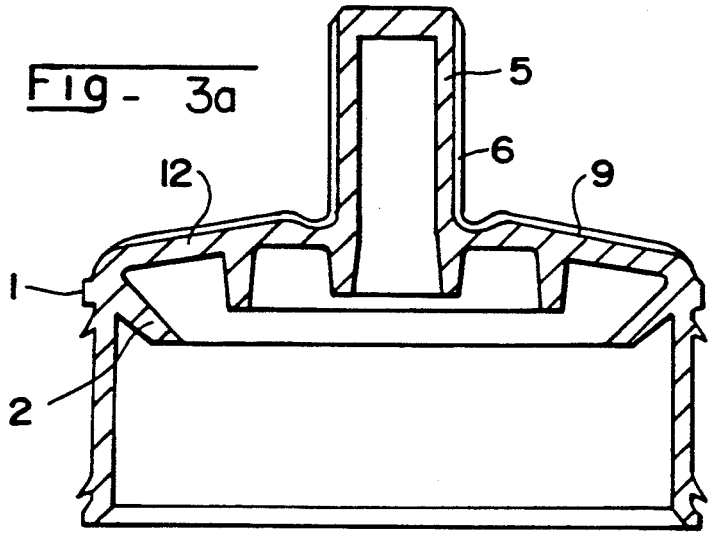
FIGS. 3*a* and 3*b* show modifications of the plunger according to FIG. 2 in axial cross-section and plan view.
Figure 3B:
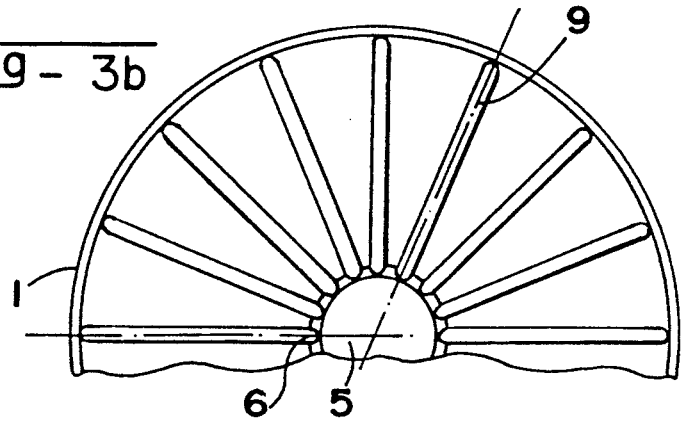

FIGS. 3*a* and 3*b* show a further development of the embodiment illustrated in FIG. 2, in that the flat grooves 6 of the journal 5 continue into flat radial grooves 9 of the plunger end wall 12.

Figure 4A:
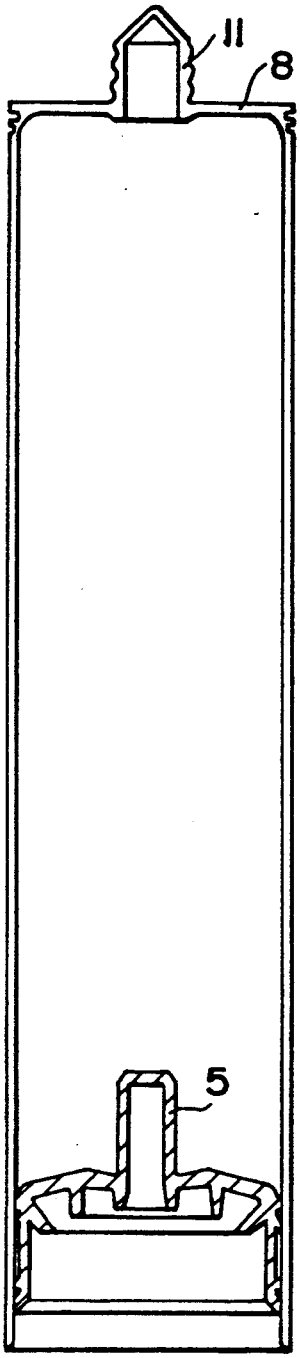
FIGS. 4*a*, 4*b* and 4*c* show cartridge according to the invention having a plunger as in FIG. 2 or 3 in various positions.
Figure 4B:
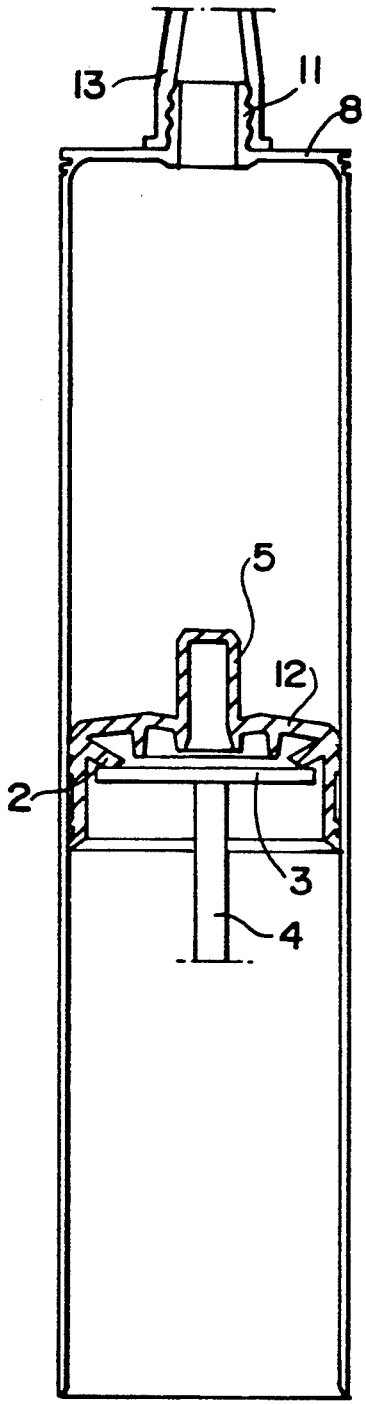
Figure 4C:
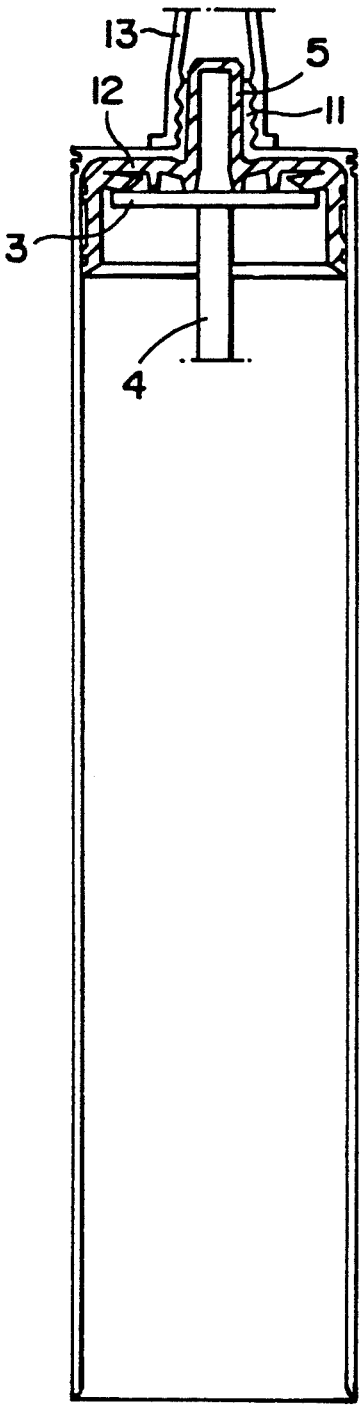

FIGS. 4*a*, 4*b* and 4*c* show the cartridge according to the invention in three successive states. FIG. 4*a* shows the filled cartridge (contents not shown), with the plunger closing off the rear open end of the cartridge body. The outlet nipple 11 at the end wall 8 of the cartridge body is closed by a molded-on conical cap. FIG. 4*b* shows the cartridge in a semi-expressed state. The cover cap of the nipple 11 has been cut off and injection nozzle in the form of a spout 13 has been screwed onto the nipple 11. The pressure plate 3 at the front end of the pressure ram 4 of an extraction pistol presses the plunger, via its inner rib 2, in a forward direction. FIG. 4*c* shows the fully expressed cartridge. The plunger is in its foremost position, the pressure plate 3 still lies against the rear side of the plunger and has now pressed the previously slightly vaulted plunger end wall 12 so that it lies with its entire surface area against the flat end wall 8 of the cartridge body. The journal 5 of the plunger has passed through the nipple 11 and slightly projects therefrom as a visual indication that the cartridge is totally empty. Virtually all residual material has escaped through the grooves 6 on the journal 5 (in the embodiment of the plunger of FIG. 2) or through the grooves 9 and 6 on the plunger end wall and journal (in the embodiment of the plunger of FIGS. 3*a* and 3*b*).

The spout 13 containing the residual material is unscrewed and discarded, and the cartridge, which virtually no longer contains any residual material, may be supplied to the reworking system.

Figure 4D:
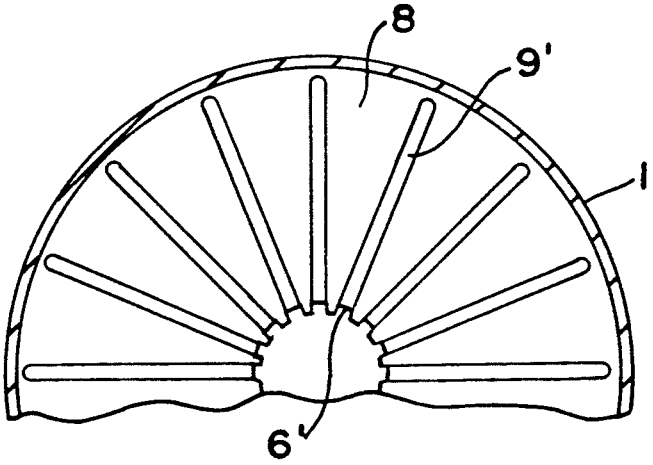
FIG. 4*d* is an axial cross-section showing an inner surface of the cartridge end wall.

As regards the grooves 6 and 9, it should be noted that, instead of the grooves being formed on the journal 5 of the plunger and in the front face of the plunger, they may alternatively be formed on the nipple inner wall and the inside of the end wall 8 of the cartridge body. Please refer to grooves 6' and 9' shown in FIG. 4*d* for this alternative embodiment. For production engineering reasons, however, the arrangement of the grooves on the plunger is to be preferred.

Figure 5:
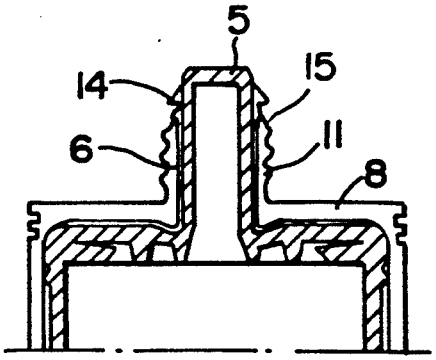
FIG. 5 is an axial cross-section, the front end region of a cartridge according to the invention with a further modification of the plunger.

FIG. 5 shows the plunger of FIG. 2 or 3 modified in such a way that there are formed, on the front journal end, radial projections 14 which, when the journal 5 penetrates the outlet opening of the nipple 11, snap over the outer nipple edge 15 and prevent the plunger from springing back. Practice has shown, however, that such projections are not in fact needed because the plunger is seated with its periphery so tightly fitted in the cartridge body that no spring-back occurs.

Figure 6:
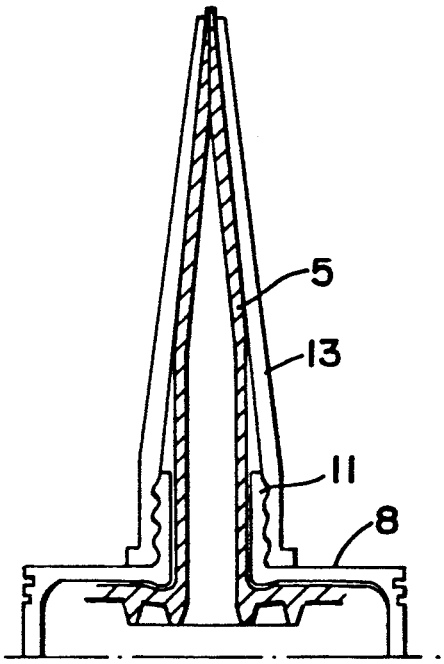
FIGS. 6 and 7 show axial cross-sections through the front cartridge end according to further embodiments of the invention.
Figure 7:
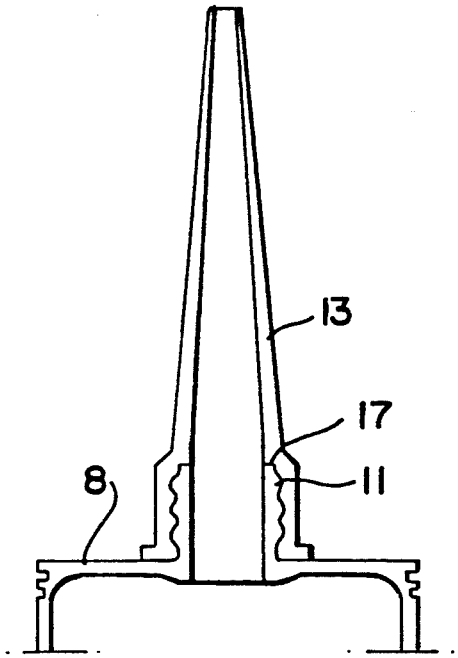

FIG. 6 and 7 show modifications of the invention to the effect that the interior of the spout 13 is also fully discharged.

According to FIG. 6, the journal 5 of the only partially illustrated plunger is constructed with such a length and with a shape corresponding to the internal contour of the spout 13 that, when the plunger is pushed fully forward, the journal penetrates both the outlet opening of the nipple 11 and the interior of the spout 13. In FIG. 6, residual material is left only in the spaces between the front end of the nipple 11 and a short axial portion of the conical inner wall of the spout 13.

In FIG. 7, the spout is modified in that, internally, it has a shoulder 17 which, when the spout 13 is screwed onto the nipple 11, comes to lie against the front end of the nipple so that the internal contour of the spout 13 adjoins the nipple opening virtually continuously and there are no longer any spaces between the suitably constructed journal of the plunger (not shown) and the spout inner wall, as is still the case in the embodiment of FIG. 6.

Figure 8A:
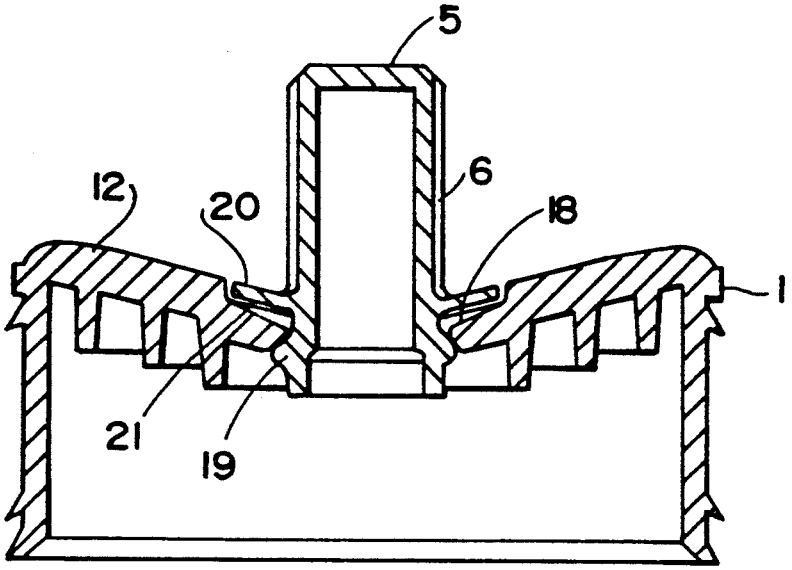
FIGS. 8*a* and 8*b* show axial cross-sections, a plunger according to the invention with an air escape valve in a closed and opened state.
Figure 8B:
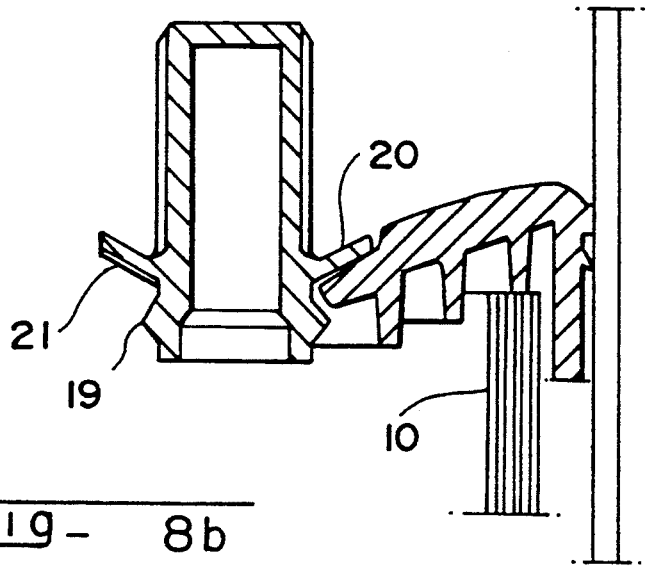

FIGS. 8*a* and 8*b* show a further embodiment of the plunger according to the invention, in which the journal 5, which is provided at its peripheral surface with axial continuous grooves 6, is manufactured as a separate part and is clipped into a central opening in the plunger end wall 12. There it lies against the opening in the plunger end wall, with a front shoulder in the form of a radial flange 20 against the front edge and with a rear bead 19 against the back edge of the opening. The radial flange 20 is elastic and presses the journal 5 in the plunger end wall resiliently forward so that the bead 19 rests against the back edge of the opening in the plunger end wall 12. The rear side of the radial flange 20 is provided with a plurality of radial grooves 21 forming air passage channels, and the annular bead 19 together with the opposing surface of the edge of the opening in the plunger end wall 12 forms an air escape valve which, when the plunger is inserted into the rear end of a filled cartridge, allows any air still trapped to escape. That is, when the journal 5 is resiliently pressed back a little, the bead 19 lifts a little from its opposing surface and trapped air may escape. The spring action of the radial flange 20 on the journal 5 however ensures in each case that the air escape valve immediately closes again. In FIG. 8*a*, the air escape valve is shown closed and, in FIG. 8*b*, it is shown open while a rammer 10 presses the plunger into the rear end of the cartridge.

Figure 9:
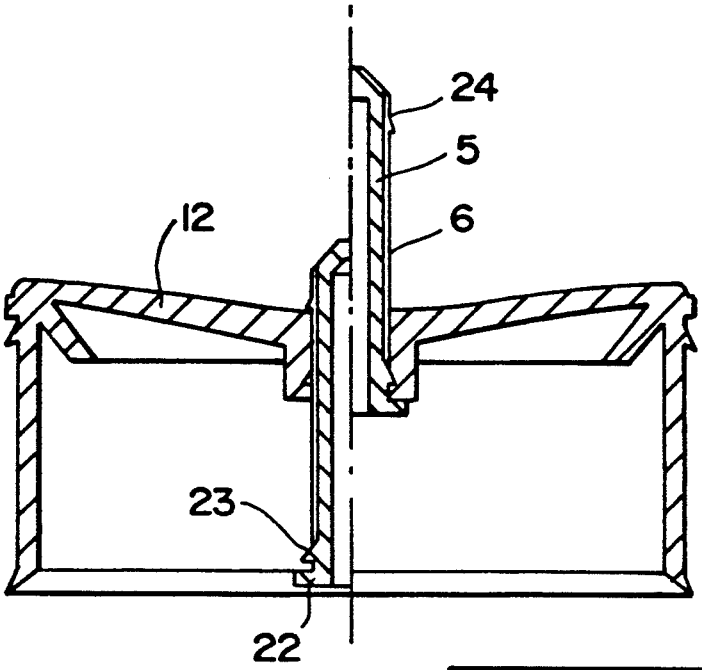
FIG. 9 shows a further embodiment of a plunger with a movable journal.

Finally, FIG. 9 again shows an embodiment of a plunger according to the invention, in which the journal 5 is manufactured as a separate part and is inserted in an axially displaceable manner into a central opening in the plunger end wall. The journal is once more provided with longitudinal grooves 6 in its peripheral surface. At the front (naturally, not in the region of the grooves 6), the journal has small radial lugs 24 which, after insertion of the journal into the opening in the plunger end wall 12, prevent the journal falling out again. Formed on the rear end of the journal 5 are a radial lip 23 and a rear stop flange 22, which cooperates with corresponding counter elements in the opening in the plunger end wall 12. FIG. 9 shows, in the left half, the journal 5 inserted into the opening in the plunger end wall but still in its rear position with radial lugs 24 resting against the front face of the plunger and, in the right half, the journal 5 in its advanced position, in which radial lip 23 has snapped into the corresponding groove in the opening in the plunger end wall and the stop flange 22 rests against the rear side of the thickened portion, containing the opening, rear side of the thickened portion, containing the opening, of the plunger end wall.

In the plunger, during insertion of the plunger into the rear end of a filled cartridge, the grooves 6 serve as air escape channels through which air escapes until finally the plunger rests entirely against the material and then the journal 5 is pushed forward and snaps into its front position.

In each of the embodiments of FIGS. 8 and 9, the plunger end wall has a concave shape, thereby making it easier to express the residual volume through the channels 6 of the journal. In this embodiment too, the close fit of the doctor lip 1 against the inner wall of the cartridge body arises in that , when pressure is exerted upon the rear end of the plunger, the plunger and wall 12 tries to flatten and hence exerts a radial compressive force component outward towards the cartridge body wall.

I claim:

1. A cartridge for paste-like substances, comprising:

a tubular cartridge body closed at one end by a front end wall having an outlet nipple defining an outlet opening;

a plunger for pressing such a paste-like substance through the outlet opening, said plunger being inserted into an open rear end of the cartridge body, wherein an outer periphery of the plunger is in sealing contact with an inner wall of the cartridge body;

a journal protruding from and fixed to said plunger, said journal being adapted to penetrate the outlet opening when the plunger rests against the front end wall of the cartridge body, said journal being at least the same length as the outlet opening;

at least one continuous axial groove formed in at least one of an outer peripheral surface of the journal and an inner wall of the outlet opening, wherein the plunger is adapted to have substantially its entire front face contact the front end wall of the cartridge body upon forcing the journal through the outlet opening; and radially extending grooves formed on at least one of an inner surface of the front end wall of the cartridge body and the front face of the plunger.

2. The cartridge of claim 1, wherein the length of the journal is greater that the length of the outlet opening.

3. The cartridge of claim 2, further comprising at least one radial projection disposed along an outer radial periphery of a front end of the journal which protrudes from the nipple to prevent reverse axial movement of the plunger.

4. The cartridge of claim 1, wherein said at least one continuous axial groove is defined by a plurality of continuous axial grooves.

5. The cartridge of claim 1, wherein the plunger is rigid and said front face has a contour corresponding to the inner surface of the front end wall of the cartridge body.

6. The cartridge of claim 1, wherein said front face of the plunger has a convex contour and said plunger is resilient such that when pressure is exerted upon the rear side of the plunger, substantially the entire front face conforms to the inner surface of the front end wall of the cartridge body.

7. The cartridge of claim 6, wherein a bending strength of the plunger increases radially from its outer edge inwards.

8. The cartridge of claim 1, wherein said front face of the plunger has a concave contour and said plunger is resilient such that when pressure is exerted upon the rear side of the plunger, substantially the entire front face conforms to the front end wall of the cartridge body.

9. The cartridge of claim 8, wherein a bending strength of the plunger increases radially from its outer edge inwards.

10. The cartridge of claim 1, wherein the journal is inserted into the plunger so as to be axially displaceable in a forward direction with respect to said plunger and is provided at its rear end region with an annular groove which, when the journal is pushed forward, snaps into a corresponding counter element of the plunger and locks the journal in position relative to said plunger.

11. The cartridge of claim 1, further comprising an air escape valve provided between the journal and plunger, said valve opening when pressure is exerted upon the front face of the plunger.

12. The cartridge of claim 11, wherein the air escape valve is formed by an inner edge of the plunger which defines an opening receiving the journal, and an annular bead which radially outwardly protrudes from the journal, wherein said bead engages said inner edge to define closed position of said air escape valve, and a gap is formed between said inner edge and said bead to define an open position of said air escape valve.

13. The cartridge of claim 12, wherein the journal has an annular resilient locating shoulder resting against the front face of the plunger, and grooves forming air channels arranged along an underside surface of said shoulder to provide air communication between said air control valve and an interior of said cartridge.

14. The cartridge of claim 1, wherein the outlet nipple is extended to form an outlet nozzle, and the journal has a shape and length corresponding to an internal contour of the outlet nozzle.

15. The cartridge of claim 1, further comprising a spout placed on the outlet nipple, the journal having a shape corresponding to an internal shape of said spout.

16. The cartridge of claim 15, wherein the spout has an internal shoulder which rests against a front face of the outlet nipple to form a smooth continuous internal contour of the outlet nipple and the outlet nozzle.

17. The cartridge of claim 1, wherein the journal is shaped to substantially conform to an internal contour of the outlet nipple.

18. The cartridge of claim 17, wherein substantially the entirety of the inner wall of the outlet opening is pressed by and in contact with the outer peripheral surface of the journal upon the journal penetrating the outlet opening.

* * * * *

UNITED STATES PATENT AND TRADEMARK OFFICE

CERTIFICATE OF CORRECTION

PATENT NO. : 5,316,186

DATED : May 31, 1994

INVENTOR(S) : Eugen PRESTELE

It is certified that error appears in the above-identified patent and that said Letters Patent is hereby corrected as shown below:

On the title page, Item [76], line 2, change "Strasse" to --StraBe--.

Item [30], line 2, change "9110529" to --G 91 10 529.3--.

Signed and Sealed this

Sixteenth Day of August, 1994

*Attest:*

*Attesting Officer*

BRUCE LEHMAN

*Commissioner of Patents and Trademarks*